US005193976A

United States Patent [19]

Kolev et al.

[11] Patent Number: 5,193,976

[45] Date of Patent: Mar. 16, 1993

[54] INJECTION DEVICE FOR THE ON-LINE WET CLEANING OF COMPRESSORS

[75] Inventors: Sejko Kolev, Brugg; Rudolf Robben, Wettingen, both of Switzerland

[73] Assignee: Turbotect Ag, Baden, Switzerland

[21] Appl. No.: 768,763

[22] PCT Filed: Feb. 8, 1991

[86] PCT No.: PCT/CH91/00035

§ 371 Date: Oct. 15, 1991

§ 102(e) Date: Oct. 15, 1991

[87] PCT Pub. No.: WO91/12433

PCT Pub. Date: Aug. 22, 1991

[30] Foreign Application Priority Data

Feb. 14, 1990 [CH] Switzerland ..... 480/90-3

[51] Int. Cl.[5] ..... F04D 29/70

[52] U.S. Cl. ..... 415/116; 415/121.3; 239/587.4; 134/23; 60/39.33

[58] Field of Search ..... 415/110, 116, 121.3; 239/587.3, 587.4; 134/22.18, 23, 32; 417/160; 60/39.33

[56] References Cited

U.S. PATENT DOCUMENTS

| | | | |
|---|---|---|---|
| 2,689,456 | 9/1954 | White | 134/23 |
| 3,377,026 | 4/1968 | DeMart et al. | 239/587.4 |
| 3,421,702 | 1/1969 | O'Brien | 239/587.4 |
| 3,623,668 | 11/1970 | Freid | 134/32 |
| 4,196,020 | 4/1980 | Hornak et al. | 134/23 |
| 5,011,540 | 4/1991 | McDermott | 134/22.18 |

FOREIGN PATENT DOCUMENTS

| | | |
|---|---|---|
| 1563749 | 4/1969 | France . |
| 2258102 | 8/1975 | France . |
| 2418355 | 9/1979 | France . |
| 341262 | 11/1959 | Switzerland . |
| 758530 | 10/1956 | United Kingdom . |

OTHER PUBLICATIONS

Patent Abstracts of Japan, vol. 6, No. 50 (M-120)(928) 3 Apr. 1982, & JP-A-56 165800 (Hitachi) 19 Dec. 1981.

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

In an injection device for the ON-LINE wet cleaning of compressor, the liquid cleaning agent is injected via a nozzle into the flow passage upstream of the compressor. The nozzle is a molecular atomizer which is mounted in the casing wall of the compressor in such a way that it can be adjusted in a three-dimensional manner in a ball-and-socket joint and can be maintained, adjusted or even exchanged during the operation of the machine.

1 Claim, 2 Drawing Sheets

INJECTION DEVICE FOR THE ON-LINE WET CLEANING OF COMPRESSORS

BACKGROUND OF THE INVENTION

1. Field of the Invention

The invention relates to an injection device for the ON-LINE wet cleaning of compressors, by means of which injection device the liquid cleaning agent can be directed via a nozzle into the flow passage upstream of the compressor.

2. Discussion of Background

Conventional injection devices offer little protection against possible consequential damage to the blades. As a rule these injection devices are rebound nozzles whose connecting pieces necessarily project relatively deep into the flow passage. In particular in transonic compressors, such disturbing elements in the compressor inlet are inadmissible for technical reasons related to flow. Potential risks with regard to blade damage are of a two-fold nature: on the one hand, the connecting pieces can be shaken off in the event of resonance and be flung against the blading; on the other hand, the connecting pieces can fly out of their anchorage as a result of corrosion damage, for example pitting. The operating mode of rebound nozzles of this type is also not quite satisfactory. The atomizing of the cleaning liquid is not uniform at different drop sizes. This can lead to the partial inducement of vibrations at the blading. Furthermore, there is the possibility of erosion of the blade coating. In addition, the nozzle output can be set only by pressure change, in the course of which, however, the drop size is directly affected. Finally, the direction of the nozzle jet can also only be varied around the connecting-piece axis itself, which makes it impossible to individually adapt the nozzle jet to the prevailing flow conditions.

SUMMARY OF THE INVENTION

Accordingly, one object of the invention is to provide a novel device of the type mentioned at the beginning which on the one hand is adjustable in spray output and spray direction and on the other hand provides maximum protection for the compressor blading against parts of the device detached by force.

According to the invention, this is achieved in that the nozzle is a molecular atomizer which is mounted in the casing wall of the compressor in such a way that it can be adjusted in a three-dimensional manner in a ball-and-socket joint.

The advantage of the invention can be seen in particular from the fact that, on account of the commercially available nozzle used in a universal insert, output corrections as well as adjustments to the direction of the nozzle jet and the type of nozzle jet can be carried out when the compressor is running without impairing the operation of the machine.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Parts of the compressor which are not essential to the invention have been omitted. The flow directions of the operating media are designated by arrows.

DESCRIPTION OF THE PREFERRED EMBODIMENTS

Figure 1:
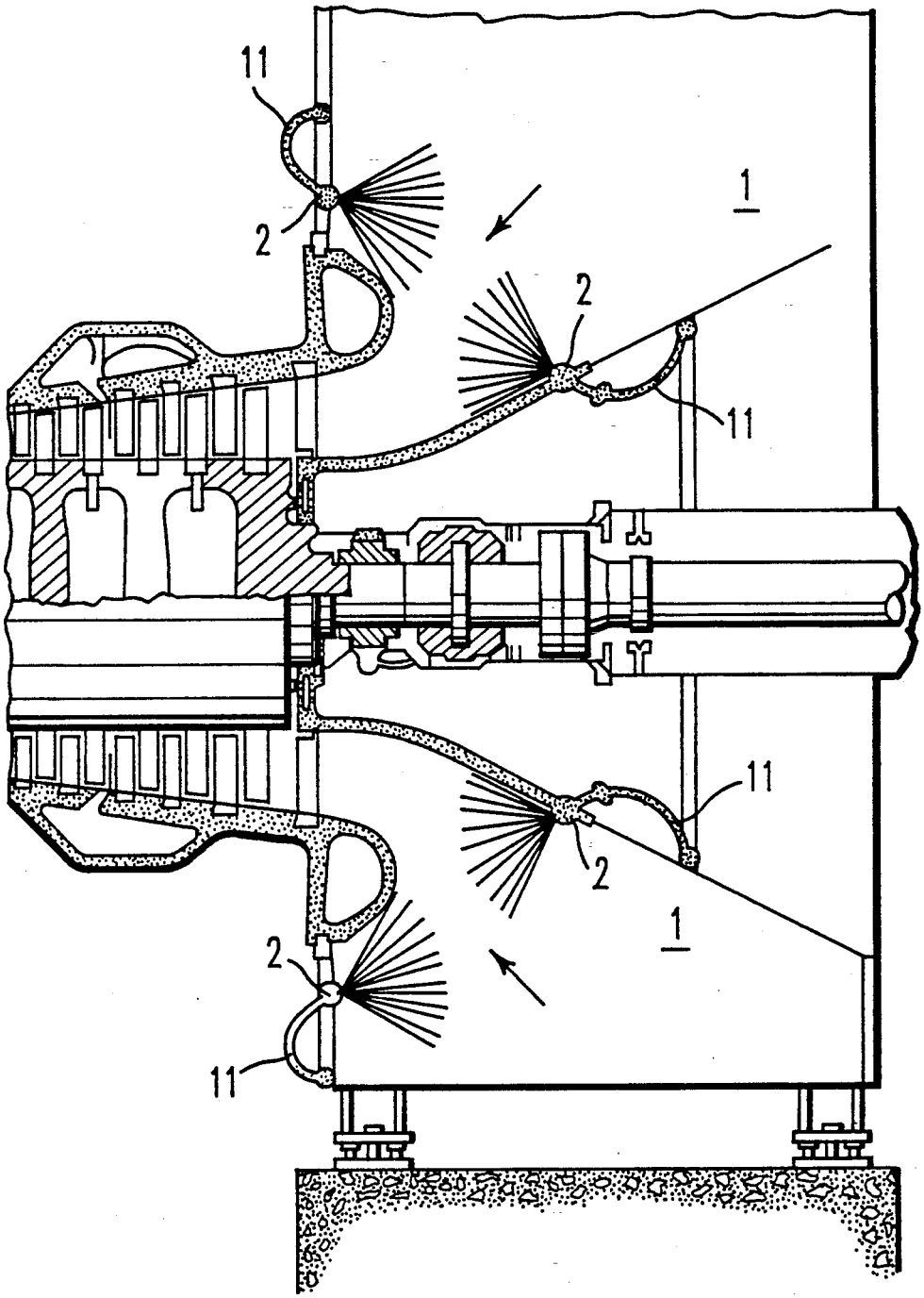
FIG. 1 shows a schematic longitudinal section through the inlet portion of an axial compressor.

Referring now to the drawings, wherein like reference numerals designate identical or corresponding parts throughout the several views, in FIG. 1, four installation examples for the injection nozzles are shown. It goes without saying that, irrespective of the configuration of the compressor inlet selected, the positions and number of nozzles are to be selected in such a way that on the one hand they act on the entire through-flow cross-section and on the other hand they are accessible from outside. The medium to be injected is as a rule a mixture of a commercially available concentrate and prepared water.

Figure 2:
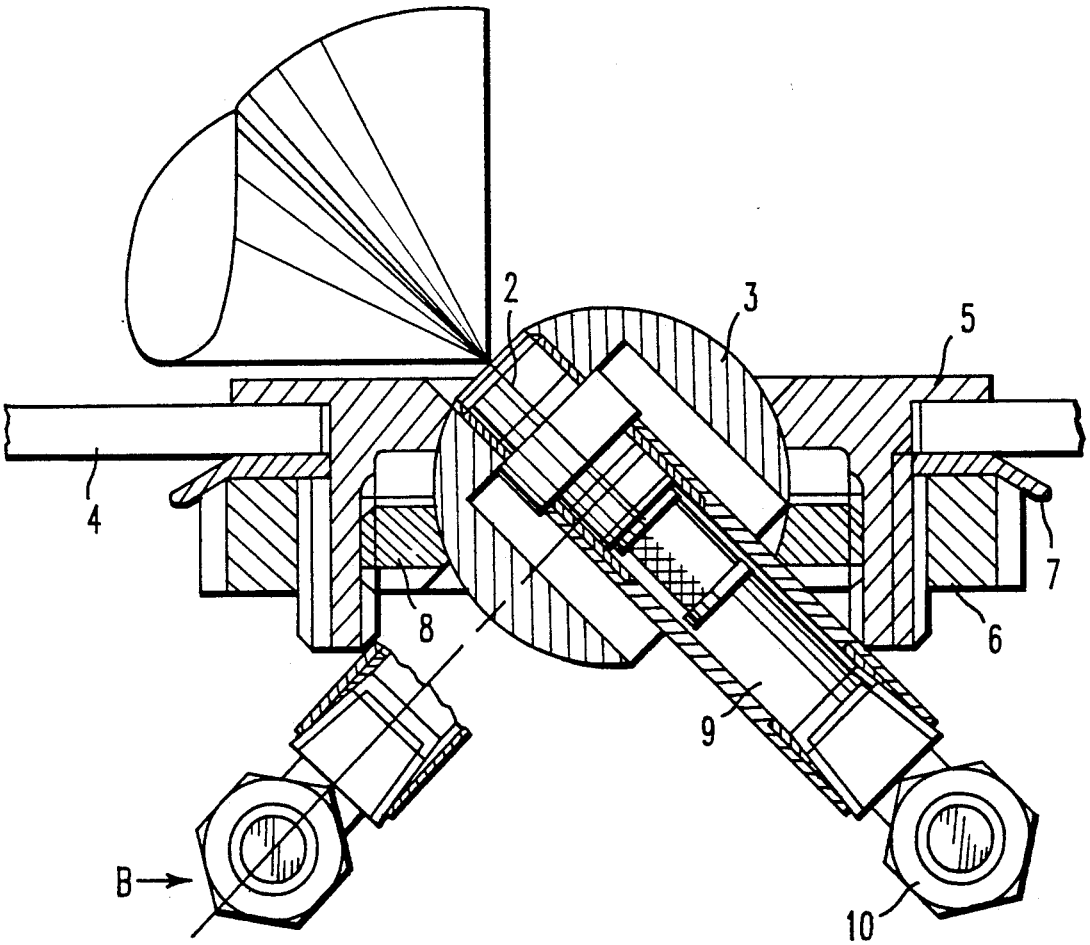
FIG. 2 shows a sectional representation of the mounted adjustable injection device.

According to FIG. 2, this mixture is injected into the through-flow passage 1 via a molecular atomizer 2. This atomizer 2 is fastened in the interior of a ball-and-socket joint 3 by means of a screw thread in such a way that the nozzle orifice is at least approximately flush with the ball surface. In the case shown, the spray cone has an angle of about 90°. This means that the longitudinal axis of the atomizer only has to be set at 45° to the flow-limiting wall 4 of the compressor casing in order to cover the wall zones.

This case shown applies, for example, to an injection form in which the mixture is injected in the flow direction of the air flowing into the compressor. If, however, the mixture is to be injected against the flow direction of the fresh air drawn in, the ball-and-socket joint merely has to be swung round through 90° into the position designated by B.

In order to make these and other adjustments during the operation of the machine, the ball-and-socket joint 3 lies in a joint shell which is made in a casing 5. This casing of preferably cylindrical form, which passes through the compressor wall 4, lies with a flange-like base on the inside of the compressor wall. The joint shell is arranged in this base. The cylindrical part of the casing 5 projecting on the outside of the compressor wall is provided with both an internal thread and an external thread. Via the latter, the casing is firmly screwed to the wall 4 by means of shaft nut 6 and lock washer 7. Via the internal thread, the ball-and-socket joint 3 is pressed by means of a clamping nut 8 into the joint shell and held firmly in the respective position.

The molecular atomizer 2 is connected to a feed tube 9 which carries a union piece 10 at its other end for receiving a, for example flexible, hose connection 11 (FIG. 1). The diameter of the feed tube and the axial length of the cylindrical part of the casing compressor 4 are matched to one another in such a way that the feed tube 9 can readily perform a swivel movement through 90°, and in fact in both the drawing plane and perpendicularly thereto. Consequently, no limits are imposed on the adjustability of the spray angle.

It can be recognized from FIG. 2 that the parts projecting into the through-flow compressor passage are reduced to an absolute minimum. Due to the design, it is also not possible for parts detached from the device to pass into the blading. In addition, there is hardly any risk with regard to parts possibly being shaken off or with regard to corrosion damage to the device. Those parts of the device that are in contact with the cleaning agent are of course produced from stainless materials.

The novel device is distinguished by the fact that it is extremely easy to maintain. Thus all service work such as cleaning, adjusting, inspecting and repairing can be carried out when the machine is running. This also applies of course to the actual exchange of the molecular atomizer in the event of a requisite change to its output or the shape of the nozzle jet. It has been found that it takes about 15 minutes to exchange a nozzle unit.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An injection device for ON-LINE wet cleaning of compressors, comprising:

nozzle means for directing a liquid cleaning agent onto a flow passage located upstream of a compressor inlet, the compressor comprising a casing wall; and ball joint means movably mounted in the casing wall of the compressor, said nozzle means being a molecular atomizer which is mounted in said ball joint means, said ball joint means being adjustable in a three dimensional manner for permitting said nozzle means mounted therein to be adjustable in said three-dimensional manner.

* * * * *